United States Patent [19]

Hakoi et al.

[11] 4,455,879

[45] Jun. 26, 1984

[54] INSPECTION METHOD AND APPARATUS FOR INSPECTING FASTENER SLIDERS WITH AUTOMATIC LOCK MEANS

[75] Inventors: Tsutomu Hakoi; Shinji Murata, both of Toyama, Japan

[73] Assignee: Yoshida Kogyo K. K., Tokyo, Japan

[21] Appl. No.: 324,817

[22] Filed: Nov. 25, 1981

[30] Foreign Application Priority Data

Dec. 20, 1980 [JP] Japan ..... 55-179688

[51] Int. Cl.[3] ..... G01L 5/00

[52] U.S. Cl. ..... 73/862.01; 73/862.53; 209/599; 340/688

[58] Field of Search ..... 73/161, 862.01, 862.53, 73/849; 209/599; 340/665, 678, 688

[56] References Cited

U.S. PATENT DOCUMENTS

| | | | |
|---|---|---|---|
| 1,968,866 | 8/1934 | Ames | 340/678 X |
| 2,186,693 | 1/1940 | Bradbury | 209/601 X |
| 2,564,528 | 8/1951 | Gearin | 340/688 X |
| 3,129,584 | 4/1964 | Canning et al. | 73/862.01 X |
| 4,300,398 | 11/1981 | Kaltenekker et al. | 73/849 |

*Primary Examiner*—Charles A. Ruehl

*Attorney, Agent, or Firm*—Hill, Van Santen, Steadman & Simpson

[57] ABSTRACT

An inspection method for fastener sliders with automatic lock means in which at the final step in the assembly operation of said slider, the pull tab of said slider is applied a downward biasing force thereto by a predetermined constant stroke of a dial gauge and the quality of the slider is determined by electrical detection signals which detect whether or not the balance between the resilient pressure provided by the dial gauge and the repulsion force of the pull tab falls within a predetermined range.

An inspection apparatus for fastener sliders with automatic lock means comprising an intermittent transfer member holding and transferring said slider, a dial gauge supported on a reciprocal mechanism for moving upwardly and downwardly by a predetermined constant stroke, a resilient biasing rod disposed on said reciprocal mechanism adjacent to said dial gauge and a detecting mechanism for electrically detecting whether or not the rotation of the pointer of the dial gauge falls within a predetermined range.

7 Claims, 5 Drawing Figures

INSPECTION METHOD AND APPARATUS FOR INSPECTING FASTENER SLIDERS WITH AUTOMATIC LOCK MEANS

FIELD OF THE INVENTION

This invention relates to an inspection method for fastener sliders with automatic lock means employed for opening and closing slide fasteners and an apparatus for carrying out the inspection method and more particularly, to an inspection method in which the quality of the product (fastener sliders with automatic lock means) is mechanically and rapidly determined at the final step in the assembly of the sliders and unacceptable products are effectively rejected from the production line and an apparatus for carrying out the inspection method.

BACKGROUND OF THE INVENTION

The slider with automatic lock means for a slide fastener generally has a stop member provided with an engaging pawl adapted to be resiliently protruded into the fastener chain passage channel formed in the slider body under the action of a leaf spring incorporated on the upper surface of the slider body. The stop member is required to be so designated that it smoothly engages and releases the slider in response to an external force applied to the pull tab of the slider within a predetermined resiliency range set. If the resiliency of the stop member is excessively high, the force required to release the stop member from engagement with the chain becomes too high for the pull tab to be manually operated. On the other hand, when the resiliency of the stop member is insufficient, the engaging force with which the stop member engages the chain is too low and, as a result, the slider is easily released even when only a slight external force is applied to the stop means and the slider is maintained under its unstable stopping condition. Therefore, the spring for the stop member is required to have a repulsing force within a predetermined range.

The fastener slider with automatic lock means generally incorporates a leaf spring and the rotary shaft of the pull tab within the space defined between the upper surface of the slider body and a cover secured to the slider body. And various resilient engaging constructions for sliders have been proposed. For example, in one resilient engaging construction, the engaging pawl is formed by bending the leading end of the leaf spring itself and the engaging pawl is caused to protrude into the fastener chain passage channel formed in the slider body. In another resilient engaging construction, an engaging pawl is formed at the side edge of the cover and caused to protrude into the fastener chain passage channel to thereby anchor the slider. Either of the prior art resilient slider engaging constructions is produced by in succession incorporating a plurality of different components such as a pull tab, a spring and a cover on the upper surface of the slider body and an acceptable fastener slider product can be obtained only when the components are precisely shaped and dimensioned and function properly and are properly assembled together.

However, it has been difficult to perfectly prevent the production of unacceptable fastener sliders because of varying factors such as variations in production conditions and materials and variations in processing conditions such as part supply and assembly. Therefore, the conventional inspection of such fastener sliders has been exclusively conducted by manual operation to reject unacceptable products from the production line.

Of late, fastener sliders with automatic lock means have been produced by continuous automatic high speed production, and in order to enhance the production efficiency, it has become necessary to perform the inspection step in the production operation automatically and especially as one step of a continuous production scheme. The present invention has been developed to meet this requirement.

SUMMARY OF THE INVENTION

Thus, one object of the present invention is to provide a method and apparatus to determine the quality of fastener sliders with automatic lock means in a relatively short time.

Another object of the present invention is to provide a method and apparatus to determine the quality of fastener sliders with automatic lock means mechanically and automatically.

A further object of the present invention is to provide a method and apparatus to determine the quality of fastener sliders with automatic lock means which can be incorporated in continuous production scheme of the fastener sliders.

In brief, according to the present invention, at the last step in the assembling operation of a fastener slider with automatic lock means, the quality or performace of the slider is determined by applying a downward biasing force to the pull tab by a predetermined constant downward stroke of the dial gauge, sensing the repulsing force of the engaging pawl by the rotation of the dial gauge pointer and detecting whether or not the rotation of the dial gauge is within the permissible rotation range by electrical signals and thus discriminating acceptable and unacceptable products.

The above and other objects and attendant advantages of the present invention will be more readily apparent to those skilled in the art from a reading of the following detailed description in conjunction with the accompanying drawings.

BRIEF DESCRIPTION OF THE DRAWINGS

The accompanying drawings show one embodiment of the inspection apparatus suitably employed for carrying out the inspection method according to the present invention in which.

PREFERRED EMBODIMENT OF THE INVENTION

The slider inspection method and apparatus embodying the present invention will now be described by way of the embodiment thereof as shown in the accompanying drawings.

Figure 1:
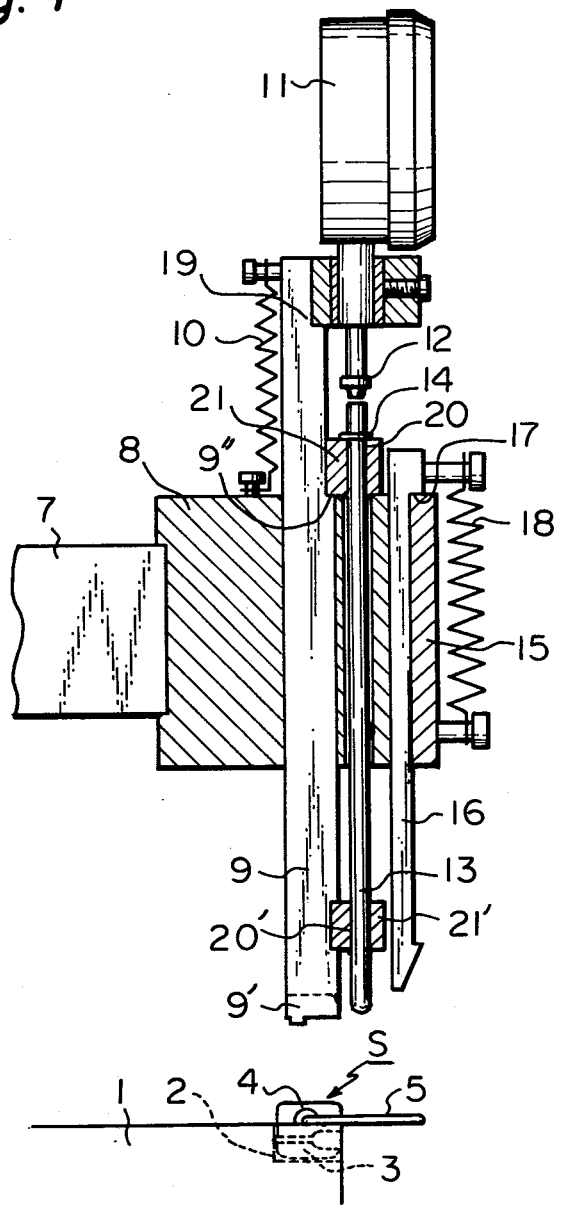
FIG. 1 is a fragmentary side elevational view in partial section of the inspection apparatus suitably employed in carrying out the inspection method according to the present invention.
Figure 2:
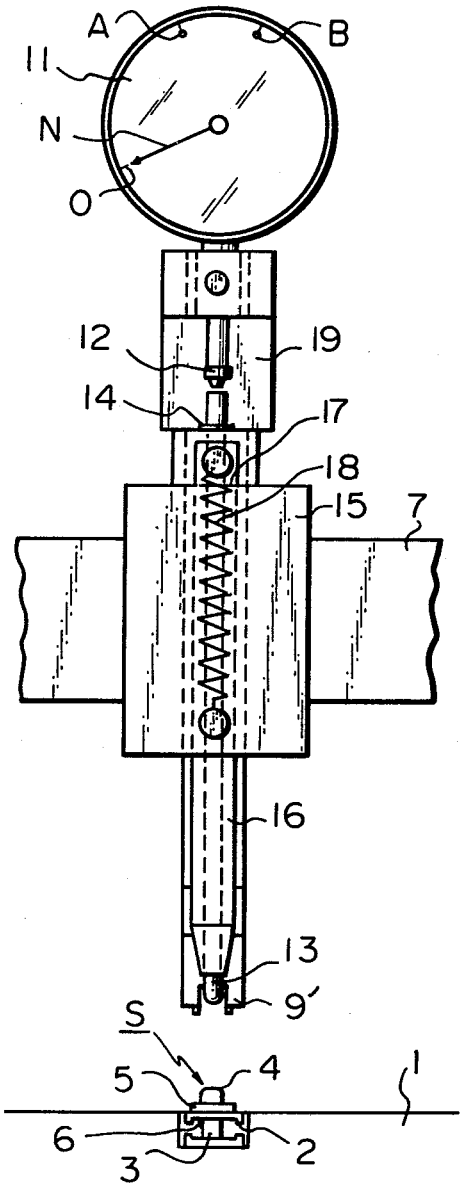
FIG. 2 is a fragmentary front elevational view of the apparatus as shown in FIG. 1.
Figure 3:
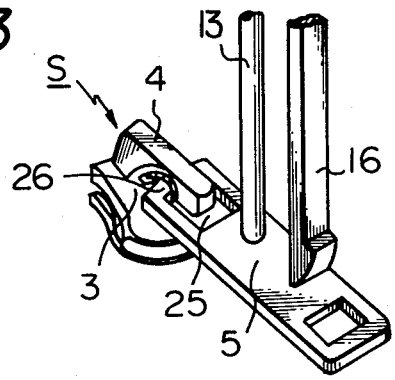
FIG. 3 is a perspective view of a portion of the inspection apparatus showing the pressure pin on the dial gauge and holding-down rod abutting against the upper surface of the pull tab on the slider having the automatic lock means.
Figure 4:
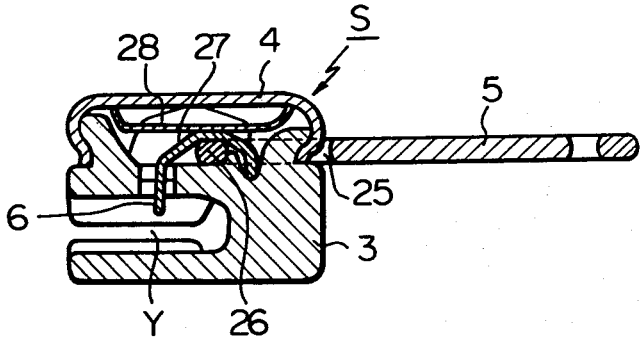
FIG. 4 is a sectional view on an enlarged scale of one example of the slider having the automatic lock means.

FIG. 1 is a fragmentary side elevational view in partial section of the apparatus by which the inspection method of the invention is carried out, FIG. 2 is a front elevational view of the apparatus, FIG 3 is a fragmentary perspective view showing the apparatus in an operative position in which the pressure pin on the dial gauge and pressure bar abut against the upper surface of the pull tab of the slider having the automatic lock means and FIG. 4 is a longitudinally sectional view of one embodiment of the slider having the automatic lock means.

The slider S having the automatic lock means as shown in FIGS. 3 and 4 generally comprises a slider body 3 which includes a fastener chain passage guide portion Y in the left-hand side portion and a diamond section on the right-hand side (as seen in FIGS. 3 and 4), a pull tab 5 supported on the upper surface of the slider body 3 and includes an opening 25 and a rotary shaft 26 at the inner end thereof, a bent pawl piece 27 formed with an engaging pawl 6 at one or the inner end projecting into the fastener chain passage guide portion Y, a leaf spring 28 abutting against the upper surface of the bent pawl piece 27 and a cover 4 fitted on the upper portion of the slider body 3 to hold the pull tab 5 for rotation about the shaft, but against separation from the slider body 3.

When no force is applied to the pull tab 5, the engaging pawl 6 protrudes into the fastener chain passage guide portion Y through a bore formed in the body 3 in communication with the portion Y as shown in FIG. 4 and holds the slider S in position on the fastener chain against displacement when the slider S is mounted on the chain. In this case, protrusion force of the engaging pawl 6 is given from the resilient force of the leaf spring 28. When any external force such as pulling or pushing force is applied to the pull tab 5, the shaft 26 pushes the bent pawl piece 27 upwardly against the biasing force of the leaf spring 28 to thereby cause the engaging pawl 6 to retract into the bore in the slider body 3 whereby the slider S is allowed to move.

When the above-mentioned components of the slider are fabricated having intended normal shapes and are properly assembled together, the slider S will function properly. However, there may be the cases in which the components are deformed, the material of the components has deteriorated and/or the components are improperly assembled. In such case, the engaging pawl 6 can not function under the operation condition intended for the engaging pawl 6 and the slider S is discarded as unacceptable.

For example, when the leaf spring 28 is deformed and/or is mounted in a slanted position, or alternatively the bent pawl piece 27 is deformed or a component or components is lacking, the product has to be rejected.

FIGS. 1 and 2 fragmentarily show the inspection apparatus adapted to detect the above-mentioned unacceptable fastener slider products. The slider with the automatic lock means S is held within the receiving groove 2 in a moving carriage 1 with the undersurface of the body 3 disposed within the receiving groove 2 and the sliders passed transverse-wise beneath the inspection apparatus by the carriage 1. The moving carriage 1 may be in the form of a rotary disc in an intermittently driven machine or a moving member which is intermittently driven by an endless chain and on which the components of the slider S are assembled.

The inspection apparatus is positioned above a predetermined stop position in the production line for producing the slider. The inspection apparatus generally comprises a support member 8 provided on a lift board 7 adapted to move upwardly and downwardly by a constant stroke in response to the termination of the movement of the moving carriage 1 and a holding-down rod 9 extending through the support member 8. The holding-down rod 9 has a dial gauge 11 secured to the upper end and a recessed holding-down piece 9' secured to the lower end. The undersurface of the holding-down piece 9' has a configuration corresponding to that of the cover 4 and the upper portion of the slider body 3 of the slider S. Secured to the holding-down rod 9 adjacent to the upper and lower ends thereof respectively are projecting members 21, 21' which have through holes 20, 20', respectively. A pressure pin 13 extends through the opening in the support member 8 and the through holes 20, 20' in the members 21, 21' and is adapted to abut against the operation rod 12 of the dial gauge 11 to form an operating rod means for the dial gauge. Secured to the front side of the support member 8 by suitable means is a mounting board 15 which holds a resiliently biased pressure bar 16. Thus, the pressure pin 13 and pressure bar 16 are adapted to move vertically relative to the support member 8.

The holding-down rod 9, pressure pin 13 and pressure bar 16 are engaged in the support member 8 against downward slipping out of the support member 8 by means of an upper shoulder 9", a holding ring 14 and an upper shoulder 17, respectively.

In the raised position of the inspection apparatus as shown in FIGS. 1 and 2, the lower end of the operation rod 12 of the dial gauge 11 and the upper end of the pressure pin 13 are slightly spaced from each other. A tension spring 10 extends between the upper end of the holding-down rod 9 and the upper surface of the support member 8. Also extending between the upper end of the pressure bar 16 and the lower portion of the mounting board 15 is a tension spring 18. Thus, the tension springs 10, 18 bias the holding-down rod 9 and pressure bar 16 downwardly, respectively.

When the slider S is received in the groove 2 in the moving carriage 1 with the undersurface of the slider body 3 extending horizontally, the pull tab 5 of the slider S is positioned extending outwardly from the moving carriage 1. With the slider S held in the moving carriage 1 in the manner mentioned above, when the pressure bar 16 moves downwardly to push the pull tab 5 down to its lowermost position, the downward stroke of the lift board 7 terminates.

In order to hold the slider S in its stabilized position, any suitable releasable pressure application device may be employed in place of the holding-down rod 9.

Figure 5:
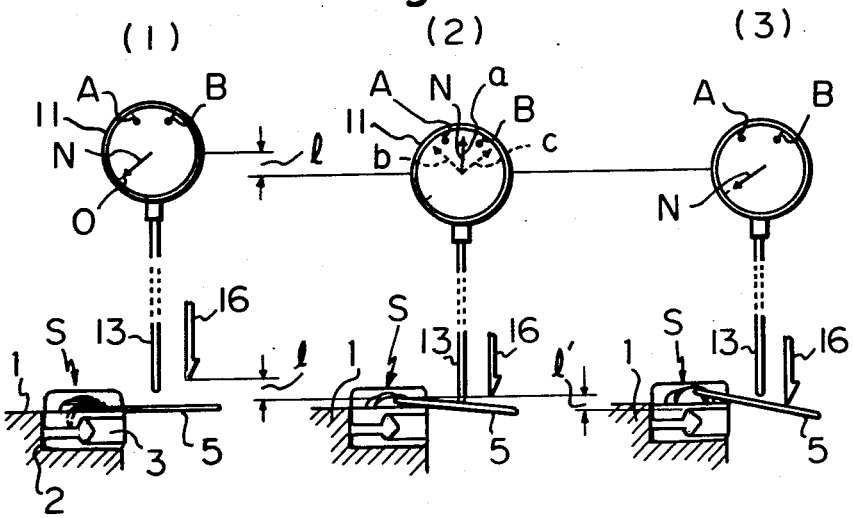
FIG. 5 is a flow sheet showing the various steps in the inspection method according to the present invention.

The contacting relationship of the pressure pin 13 and pressure bar 16 to the pull tab 5 and the movement of the pointer N of the dial gauge 11 during the downward stroke of the lift board 7 will now be described referring to FIG. 5. In the position of FIG. 5 (1), the lift board 7 is in its raised position and the pointer N of the dial gauge 11 points to 0 on the dial. When the lift board 7 descends distance 1 from the raised position to the position shown in FIG. 5 (2), the holding-down piece 9' at the lower end of the holding-down rod 9 abuts against the upper surface of the cover 4 of the slider S to thereby hold the slider in its stabilized state, and the lower end of the pressure pin 13 abuts against the upper surface of the pull tab 5. The upper end of the pressure pin 13 abuts against the operation rod 12 of the dial gauge 11 whereby biasing force of the spring acting on the dial gauge 11 and the repulsing force of the pull tab 5 balance against each other. The pointer N of the dial gauge 11 rotates in proportion to the repulsing force of the pull tab 5. When the pointer N positions itself at the point a within the acceptable angle distance defined by the lowermost contact A and the uppermost contact B (see FIG. 5 (2)), an electrical signal indicating an acceptable product is generated through any one of the contacts A, B as explained hereinafter and when the pointer N positions itself at the point b short of the lowermost contact A or at the point c beyond the uppermost contact B, an electrical signal indicating an unacceptable product is generated through any one of the contacts A, B. When the lift board 7 further descends by the distance l' from the position as shown in FIG. 5 (2) to the position as shown in FIG. 5 (3), the holding-down rod 9 continues to abut against the upper surface of the cover 4 of the slider S and only the pressure bar 16 further biases the pull tab 5 downwardly. Accordingly, the lower end of the pressure pin 13 separates from the pull tab 5 and the pointer N of the dial gauge 11 returns to 0 point.

The downward stroke of the lift board 7 is represented by l+l' and as the lift board 7 ascends from the position of FIG. 5 (3) to that of FIG. 5 (2), the lower end of the pressure pin 13 abuts against the pull tab 5 again and the pointer N of the dial gauge 11 rotates to generate electrical signals as described in connection with the position of the lift board shown in FIG. 5 (2), thereafter the lift board ascends rapidly to the position of FIG. 5 (1). By this time, the moving carriage 1 has moved by a predetermined increment so as to position the next slider holding groove in the moving carriage in the inspection position in the production line and stops there. On the other hand, the preceding slider holding grooves in the same moving carriage have advanced beyond the inspection position in the production line and in the advanced position, the sliders S are segregated as "acceptable products" and "unacceptable products", respectively, in accordance with the discrimination function of the electrical signals generated in the inspection position.

In the inspection procedure, the positions of the lowermost and uppermost contacts A and B may be, of course, adjusted to meet particular properties of products to be inspected. The electrical circuit in which the electrical contacts A and B constitute circuit components is so arranged so that the contacts A, B are maintained ON during the downward stroke of the lift board 7. On one downward stroke of the lift board 7, when the product is acceptable, an electrical signal is generated two times at the contact A, and when the pull tab 5 of the slide S has an exceedngly high repulsing force or the pull tab 5 would not bias, an electrical signal is generated four times at the contacts A, B. On the other hand, when the pull tab 5 has insufficient repulsing force or the slider S is not provided with the pull tab 5, no electrical signal is generated at the contacts A, B. In this way, the inspected products can be determined as acceptable or unacceptable depending upon the electrical signal generated.

The purpose of giving maximum biasing to the pull tab 5 by the pressure bar 16 is to return the pointer N to the pointer 0 once and to cause electrical signals to be generated in the same manner as described in connection with the downward stroke of the board 7 to thereby determine the restoring force of the spring incorporated in the slider S.

As described hereinabove, according to the inspection method of the present invention, the quality of the sliders having the automatic lock means incorporated therein can be promptly and precisely determined by mechanical means. And the inspection apparatus in which the inspection method is carried out can perform the inspection method smoothly and positively and thus, the present invention greatly contributes to the slide fastener art.

What is claimed is:

1. An inspection method for a fastener slider provided with automatic lock means having a resilient engaging construction in which, at the final step in assembly operation of said slider, said slider is positioned with the undersurface of the slider body held horizontal and a pull tab of the slider contacting the upper surface of said body and extending outwardly from said body horizontally, a downwardly biasing force is applied to said pull tab by a constant stroke of an operating rod means connected to a force sensing dial gauge from above and the quality of said slider is determined by electrical detection signals generated by the operation of electrical contacts establishing a value range on the dial gauge and activated by a pointer on said dial gauge, depending upon whether or not the resilient repulsion of said pull tab due to said resilient engaging construction of the automatic lock means is within the value range set by said electrical contacts.

2. The method of claim 1 in which said dial gauge pointer is returned to a zero value once during said constant stroke.

3. The method of claim 2 in which said determination of quality of said slider is effected based on the number of said electrical detection signals generated by the electrical contacts during said constant stroke.

4. An inspection apparatus for a fastener slider provided with automatic lock means having a resilient engaging construction comprising an intermittent transfer member adapted to hold said slider with the undersurface of the slider body extending horizontally and a pull tab associated with the slider contacting the upper surface of said slider body and extending horizontally, a force sensing dial gauge supported on a reciprocal mechanism which moves upwardly and downwardly by a constant stroke toward and away from the upper surface of said pull tab while said intermittent transfer member rests, an operating rod means extending downwardly from said dial gauge for engagement with the upper surface of said pull tab, and a detection mechanism having a electrical signal circuit with electrical contacts disposed at the extremes of a predetermined rotation range of a pointer of said dial gauge for detecting the resilient repulsion of said pull tab due to said resilient engaging construction of the automatic lock means.

5. The apparatus of claim 4, said apparatus further including a holding-down rod resiliently supported on said reciprocal mechanism to abut against the upper surface of said slider.

6. The apparatus of claim 5, wherein the lower end of said holding-down rod is positioned below the lower end of said operating rod means.

7. The apparatus of claim 4, wherein said operating rod means comprises a pressure pin up and down movably supported on said reciprocal mechanism, the upper end of said pressure pin being positioned adjacent the lower end of an operation rod connected to said dial gauge which abuts said pressure pin after said pressure pin has engaged said pull tab upper surface.

* * * * *